US011879242B2

(12) United States Patent
Garrels et al.

(10) Patent No.: US 11,879,242 B2
(45) Date of Patent: Jan. 23, 2024

(54) EDUCTOR ASSISTED FLUSH TOILET

(71) Applicant: Kohler Co., Kohler, WI (US)

(72) Inventors: Clayton C. Garrels, Kohler, WI (US); Jeremiah J. Rauwerdink, Sheboygan, WI (US); Randal S. Graskamp, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 42 days.

(21) Appl. No.: 17/406,739

(22) Filed: Aug. 19, 2021

(65) Prior Publication Data

US 2022/0074182 A1 Mar. 10, 2022

Related U.S. Application Data

(60) Provisional application No. 63/074,816, filed on Sep. 4, 2020.

(51) Int. Cl.
*E03D 3/10* (2006.01)

(52) U.S. Cl.
CPC ..... *E03D 3/10* (2013.01); *E03D 2201/30* (2013.01)

(58) Field of Classification Search
CPC ..... E03D 11/18; E03D 3/10; E03D 11/02
See application file for complete search history.

(56) References Cited

U.S. PATENT DOCUMENTS

| | | | |
|---|---|---|---|
| 3,843,978 A | 10/1974 | Ragot | |
| 9,255,392 B2 | 2/2016 | Miyake et al. | |
| 9,464,424 B1 | 10/2016 | Wiltshire | |
| 2005/0125884 A1 | 6/2005 | Claridge | |

FOREIGN PATENT DOCUMENTS

| | | | | |
|---|---|---|---|---|
| CN | 107237378 B | | 6/2019 | |
| CN | 110629845 A | | 12/2019 | |
| CN | 210621869 U | | 5/2020 | |
| JP | H11264173 | * | 9/1999 | ..... E03D 2201/30 |
| JP | 2000240133 | * | 9/2000 | ..... E03D 11/02 |
| JP | 2003090074 | * | 3/2003 | ..... E03D 11/02 |
| JP | 2003193539 | * | 7/2003 | ..... E03D 2201/30 |
| JP | 2003206562 A | | 7/2003 | |
| JP | 3617322 B2 | | 11/2004 | |
| JP | 3632485 B2 | | 1/2005 | |
| JP | 6384926 B2 | | 8/2018 | |
| WO | 9609923 A1 | | 4/1996 | |

* cited by examiner

*Primary Examiner* — David P Angwin
*Assistant Examiner* — Nicholas A Ros
(74) *Attorney, Agent, or Firm* — Lempia Summerfield Katz LLC

(57) ABSTRACT

An educator assembly for a toilet includes a suction reservoir, a flow driving device, a first nozzle, a second nozzle, and a discharge outlet. The suction reservoir is configured to store a supply of water. The flow driving device is configured to supply a flow of water to the eductor assembly and in fluid communication with the suction reservoir to create a suction port proximate to the flow driving device and the suction reservoir. The first nozzle is at the end of the flow driving device. The second nozzle is downstream of the suction port. The discharge outlet is coupled to a trapway of the toilet and configured to receive discharge from the second nozzle downstream of the suction port.

20 Claims, 11 Drawing Sheets

EDUCTOR ASSISTED FLUSH TOILET

CROSS-REFERENCE TO RELATED APPLICATIONS

This application claims priority benefit of Provisional Application No. 63/074,816 filed on Sep. 4, 2020, which is hereby incorporated by reference in its entirety.

BACKGROUND

The present application relates generally to pumps for use in aiding the flush of a toilet. More specifically, the present disclosure relates to an eductor for assisting in the flush of a toilet.

The present disclosure relates generally to plumbing fixtures with water delivery functionality. Commercial and residential plumbing fixtures such as toilets, faucets, showers, whirlpool tubs, and urinals rely on continuous stream flows (e.g., steady-state flows, etc.) of water to perform working operations. For example, toilets rely on streams of water from a rim or a sump of a toilet bowl to clean the surfaces of a toilet bowl and to remove waste from the toilet bowl during a flush. Similarly, faucets and sprayers utilize a stream of water to provide cleaning action. However, continuous stream flows are not always effective at achieving the intended goals of the product. In the toilet example, stream flows may not be enough to remove all of the waste from the toilet bowl or to fully clean the surfaces of the toilet bowl. Larger volumes of water or higher intensity flows may be required to ensure sufficient cleaning capabilities are provided by the plumbing fixtures.

Many plumbing fixtures also include valves for controlling multiple independent jets. The valves are used to coordinate the operation and timing of each jet for the plumbing fixture. For example, a toilet may include a rim jet in a rim of the toilet bowl and a sump jet in a sump of the toilet bowl. The toilet may include electronic valves that coordinate the release of water from the rim jet and the sump jet. At the beginning of a flush, water may be provided to the sump jet to remove water contained within the toilet bowl. After the water/waste has been removed from the toilet bowl, the electronic valve may switch so that water is provided to the rim jet. Water flowing from the rim jet refills the toilet bowl and cleans the surfaces of the toilet bowl. Other applications may include electronic valves and control circuits to perform other water delivery and timing functions. However, these electronic valves typically have many moving parts and the valve and associated control circuits are expensive to manufacture.

BRIEF DESCRIPTION OF THE DRAWINGS

Objects, features, and advantages of the present disclosure should become more apparent upon reading the following detailed description in conjunction with the drawing figures, in which.

DETAILED DESCRIPTION

Before turning to the figures, which illustrate certain exemplary embodiments in detail, it should be understood that the present disclosure is not limited to the details and methodology set forth in the description or illustrated in the figures. It should also be understood that the terminology used herein is for the purpose of description only and should not be regarded as limiting.

Referring generally to the figures, a plumbing fixture includes one or more motive fluid devices or structures that are configured to control the flow of water through one or more jets (e.g., fluid outlets, outlet openings, etc.) of the plumbing fixture. The plumbing fixture may be a plumbing fixture used in a building such as a toilet, faucet, shower head, hand sprayer, bathtub, or the like. The motive fluid device may utilize a motive fluid in one chamber or channel to create suction in another channel or chamber. The motive fluid and fluid in the suction channel or chamber or combined and forcibly discharged from the motive fluid device. One embodiment of the present disclosure relates to a plumbing fixture. The plumbing fixture may be mounted and coupled to the sump of a toilet.

Figure 1:
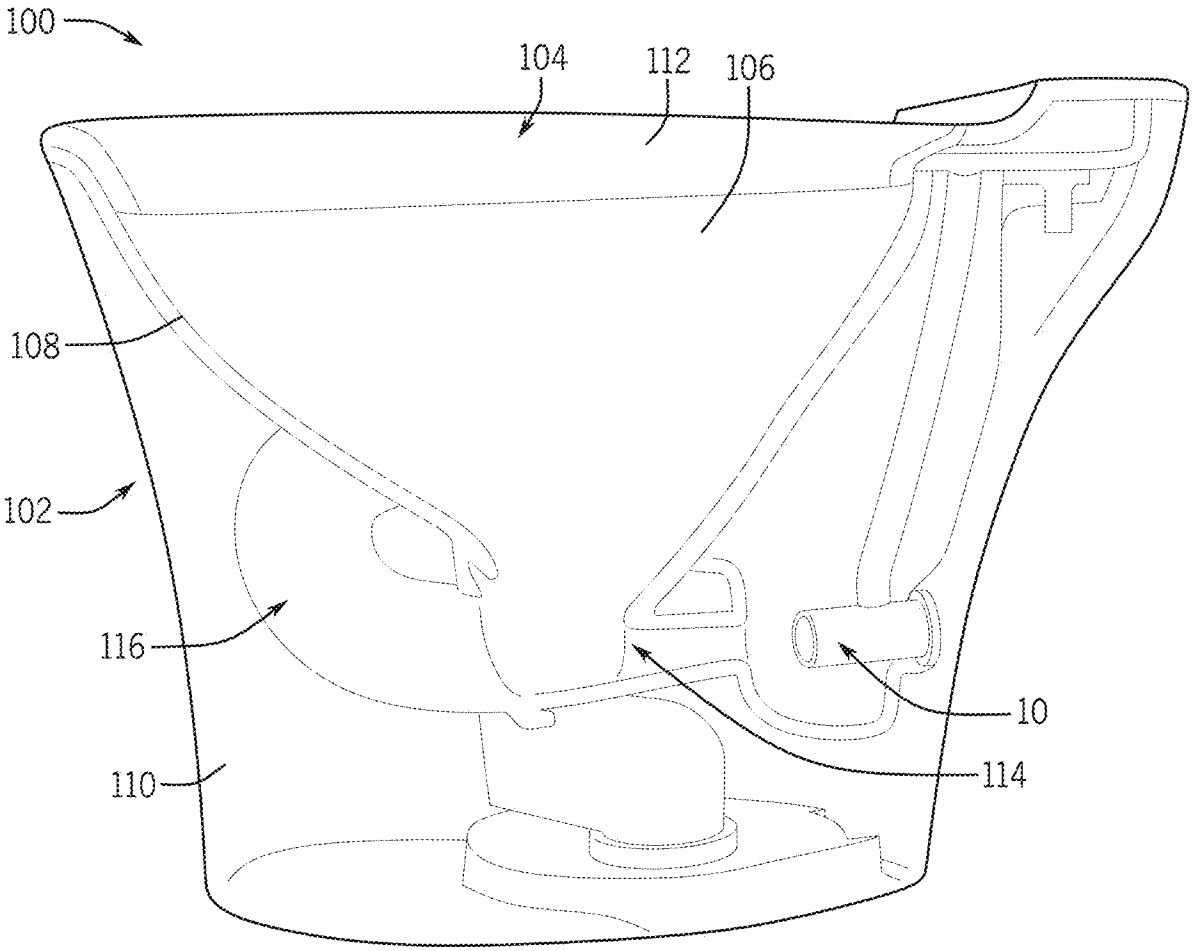
FIG. 1 illustrates an eductor assisted toilet, according to an exemplary embodiment of the present disclosure.

As shown in FIG. 1, the toilet 100 may include a toilet body 102 (e.g., a toilet housing) containing (e.g., surrounding) the various components of the toilet 100. The toilet body 102 may contain the bowl 106, the eductor assembly 10, the rim 112, the sump 114, and the trapway 116. Each of the bowl 106, the eductor assembly 10, the rim 112, the sump 114, and the trapway 116 may be integrally formed (e.g., through a casting process) with the toilet body 102 or may be coupled to the toilet body 102. Each of the toilet body 102, the bowl 106, the eductor assembly 10, the rim 112, the sump 114, and the trapway 116 may be modular components of varying shapes, sizes, and materials. For example, the bowl 106 may be cast of vitreous china and the eductor assembly 10 may be made of plastic and attached to the bowl 106. Each of the toilet body 102, the bowl 106, the eductor assembly 10, the rim 112, the sump 114, and the trapway 116 may be modular components configured to be interchanged and coupled to one or more of the modular components to form the toilet 100. Within the toilet body 102 and between the toilet body 102, the bowl 106, the eductor assembly 10, the rim 112, the sump 114, and the trapway 116 there may be hollow portions.

Each of the toilet body 102, the bowl 106, the eductor assembly 10, the rim 112, the sump 114, and the trapway 116 may be made of various materials including glazed or unglazed vitreous china and various polymers (e.g., plastics, foams, epoxy resins, etc.). The toilet body 102 and the bowl 106, eductor assembly 10, rim 112, sump 114, and the trapway 116 may be cast from a vitreous china material in a single casting process such that all the components are integrally formed. The casting process may be a solid casting process or a drain casting process. In some embodiments, the toilet body 102, bowl 106, eductor assembly 10, rim 112, sump 114, and the trapway 116 may be cast in multiple casting processes. An eductor is an example plumbing fixture. The eductor utilizes the flow of water from line pressure at one inlet to create a suction for another inlet of the eductor. The line pressure toilet 100 includes a toilet body 102. As shown in FIG. 1, the toilet body 102 is a tankless toilet configured to receive water from a water supply conduit 104. The toilet 100 may include a pedestal (e.g., base, stand, support, etc.), shown as a pedestal 110. In some embodiments, the pedestal 110 may be mounted to the wall of a lavatory and receive water through the water supply conduit 104. The water supply conduit 104 may be a water supply line inside a household, a commercial property, or another type of building. The water supply conduit 104 may be configured to supply water at a city water pressure or a well pump pressure. The water supply conduit 104 may be a pipe, tube, or other water delivery mechanism extending from a wall of the building. As shown in FIG. 1, the toilet body 102 includes a toilet bowl 106. The toilet bowl 106 includes a surface 108 (e.g., an inner surface, an interior surface, etc.) defining a cavity into which solid or liquid waste may be deposited. The toilet bowl 106 includes a rim 112 proximate to an upper edge of the toilet bowl 106. The rim 112 may extend inward from an outer edge of the toilet bowl 106. In some embodiments, the toilet body 102 is made (e.g., cast or otherwise formed) from a single piece of vitreous material such as clay. The toilet body 102 may include one or more openings (e.g., slots, holes, etc.) configured to receive trim, tubing, and/or other components/hardware to facilitate operation of the line pressure toilet 100.

As shown in FIG. 1, the toilet 100 includes a sump (e.g., a receptacle) 114 disposed at a base (e.g., lower end, etc.) of the toilet bowl 106. The toilet 100 also includes a trapway 116 (e.g., siphon, etc.) extending between the sump 114 and a drain of the toilet 100, and fluidly coupling the sump 114 to the drain such that water and waste may be flushed into a sewage line.

The toilet further includes a plurality of jets configured to facilitate flushing operations for the toilet 100 including rim jets disposed proximate the rim 112 of the toilet bowl 106. The rim jet 118 is configured to dispense water from the rim 112 into the toilet bowl 106 along the surface 108 (e.g., inner surface, interior surface, etc.) of the toilet bowl 106. The rim jet 118 cleans the surface 108 and also refills the toilet bowl 106 with water at the end of a flush. The eductor 10 is disposed proximate the sump 114 of the toilet bowl 106.

Figure 2:
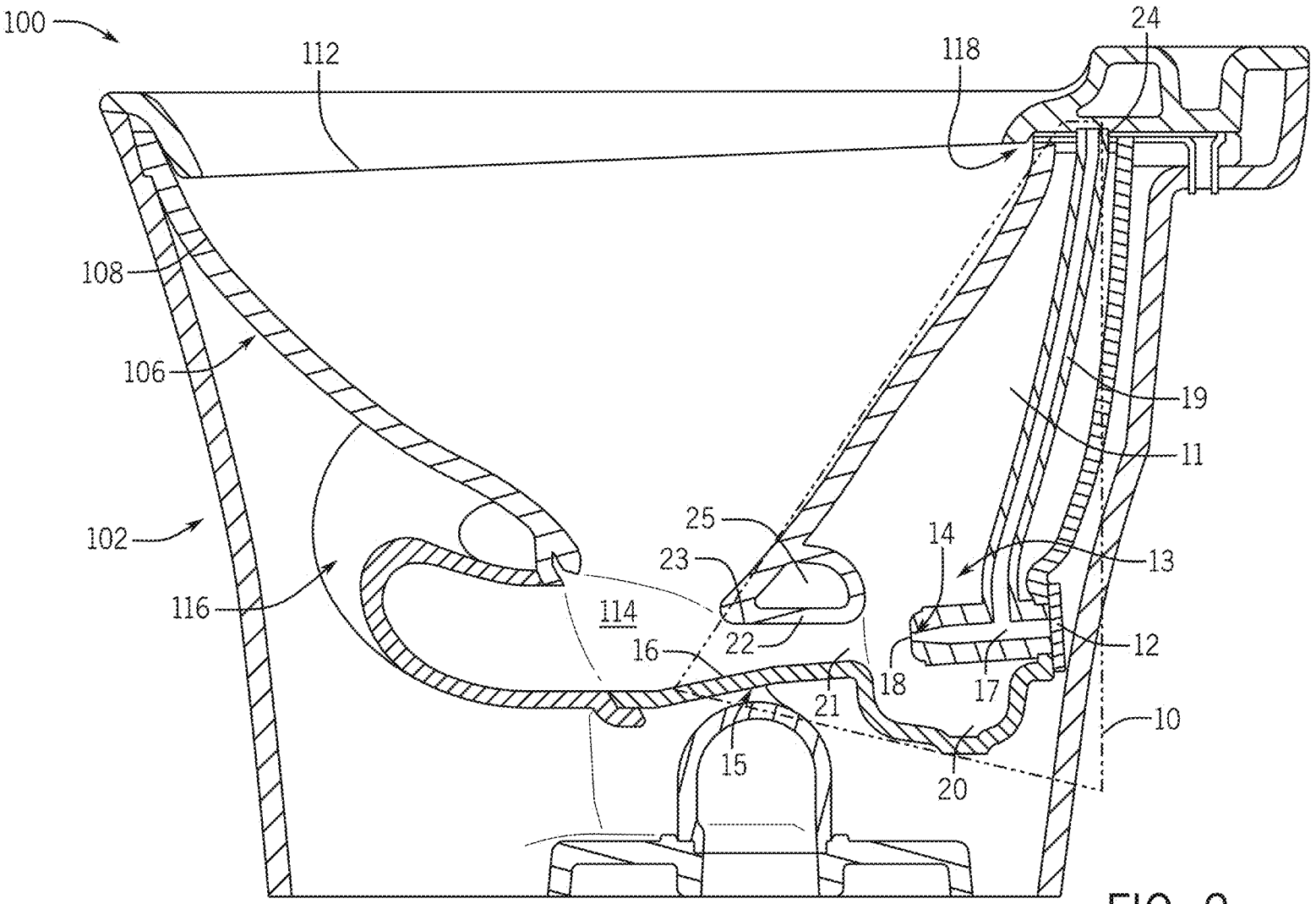
FIG. 2 illustrates a side cross section view of the eductor assisted toilet of FIG. 1, according to an exemplary embodiment of the present disclosure.

FIG. 2 illustrates a side cross section view of line pressure toilet 100, including an example eductor according to an exemplary embodiment of the present disclosure. Referring to FIG. 2, an example eductor 10 is illustrated, which, for purposes of illustration is shown by the dotted line. Portions of the eductor assembly 10 are integrally formed and/or physically attached to the toilet. Other portions may be attached to the toilet 100 during assembly. For example, a suction reservoir 11 may be attached to the bowl 106 of the toilet 100 or the suction reservoir 11 may be integrally formed with the bowl 106. The eductor assembly 10 for the toilet 100 includes a suction reservoir 11, a flow driving device 12, a suction port 13, a first nozzle 14, a second nozzle 15, and a discharge outlet 16. The flow driving device 12 includes a body portion 17, a first nozzle 14, a tapered portion 18, a water supply channel 19, and an input port 24. The suction port 13 may be a subsection of the suction region 20.

The suction reservoir 11 is configured to store a supply of water. The supply of water may be supplied by the flush cycle of the toilet 100. For example, water may be provided through the rim jet 118 of the toilet 100 (e.g., from a tank or direct supply). Some of the water, after flushing, is stored in the sump 114 and the eductor assembly 10 and specifically, in the suction reservoir 11. Water may also be stored in the passage of the nozzle 15 and/or the suction region 20. The suction reservoir 11 is attached to a bowl of the toilet 100. The suction reservoir 11 may be integrally formed with the bowl of the toilet 100 (e.g., for example the suction reservoir 11 may be cast simultaneously with the toilet 100). The suction reservoir 11 may reside within the toilet body 102. The suction reservoir 11 may be located outside of the toilet body 102.

The flow driving device 12 is configured to supply a first flow of water to the eductor assembly 10. A line supply of water (e.g., a building water supply) may supply water to the eductor assembly 10 through the input port 24 and into the water supply channel 19. The line supply of water may have a pressure of 35 psi (pounds per square inch). Water flows through the water supply channel 19, the body portion 17, and the first nozzle 14 into the suction reservoir 11. The first flow of water enters the suction reservoir 11 flowing in a first direction towards the front of the toilet 100.

The flow driving device 12 may be mounted to the suction region 20 or the suction reservoir 11. The suction region 20 may provide a predetermined minimum radius for a spherical shape formed in the eductor assembly 10 such that the predetermined minimum radius is between the outlet of the flow driving device 12 and the interior surface of the eductor assembly 10. The flow driving device may be located so that more than half of the water stored in the suction reservoir 11 is located above the flow driving device 12 and the first nozzle 14.

The input port 24 and water supply channel 19 have a first diameter. The first nozzle 14 has a second diameter less than the first diameter. The first diameter is reduced to the second diameter through the tapered portion 18 of the flow driving device 12. The first flow of water flowing through the first nozzle 14 into the suction reservoir 11 is configured to create the suction port 13 proximate to the flow driving device 12 and the suction reservoir 11.

In some embodiments, the water supply channel 19 may be located in the suction reservoir 11 of the eductor assembly 10. The water channel 19 may be located along a wall of the suction reservoir 11 (e.g., a front, back, or side wall). The supply channel 19 may be located within the suction reservoir 11 and there may be a distance between the supply channel 19 and each of the walls of the suction reservoir (i.e., when the suction reservoir 11 is full water surrounds the supply channel 19). In other embodiments, the water supply channel 19 may be located be located outside of the suction reservoir. For example, the supply channel 19 may be located alongside the suction reservoir 11 or below the suction reservoir 11. The supply channel 19 may be located between the suction reservoir 11 and the bowl 106. The water supply channel 19 may be integrally formed with the suction reservoir 11 and/or the bowl 106. The water supply channel 19 may be drain cast or solid cast. In some embodiments, the water supply channel 19 may be made of vitreous china. In other embodiments, the water supply channel 19 may be made of a polymer, for example the water supply channel may be a plastic or rubber hose. The water supply channel 19 may be made of any suitable material. The water supply channel 19 may be attached to the suction reservoir 11 at one or more points to prevent movement of the suction channel 19.

The flow driving device 12 provides a relatively high-speed flow of water into the suction reservoir 11 and/or suction region 20 in a first direction towards the front of the toilet 100. The eductor assembly 10, using this high-speed flow of water acts as a pump to provide a low pressure in the suction region 20. The Bernoulli effect from the high-speed flow of water causes suction at the suction reservoir 11 and/or suction region 20. The Bernoulli effect includes forces that pull the water from the suction reservoir 11 and/or suction region 20 to flow along with the high-speed flow of water toward the second nozzle 15. The forces are all around the outlet of the flow driving device 12 (e.g., at tapered portion 18). The forces may be inversely proportional to the distance, or the square of the distance, from the tapered portion 18 to the corresponding location in the suction reservoir 11. In some examples, all of the water in the suction reservoir 11 is forced toward the internal nozzle 15 (second nozzle). In some examples, only the water in the suction region 20 is forced toward the internal nozzle 15. Thus, in some examples, all of the water is pushed into the trapway 116 from the force of the eductor assembly 10, and in other examples, only part of the water is pushed into the trapway 116.

When the high-speed flow of water joins with the stored water in the suction reservoir 11 and/or suction region 20, the combined flow of water is both at a lower speed (slower) and includes more water (higher volumetric flow).

Figure 10:
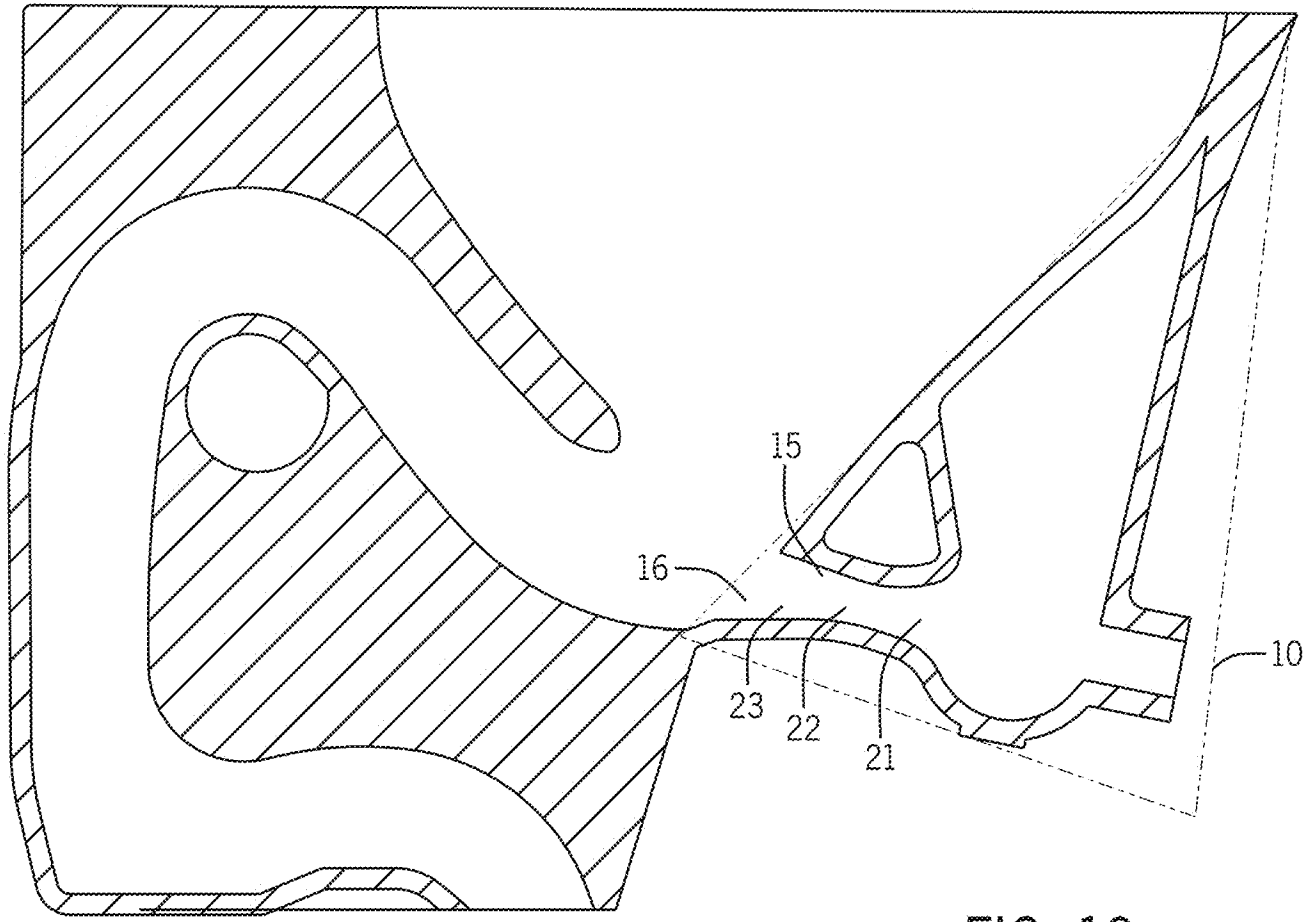
FIG. 10 illustrates another embodiment of an eductor assisted toilet according to an exemplary embodiment of the present disclosure.

The second nozzle 15 is also formed integrally with the eductor assembly 10 and the toilet 100. The second nozzle 15 may be formed integrally with the suction reservoir 11 of the toilet 100. The second nozzle 15 may be a converging diverging nozzle. FIG. 10 provides a more pronounced illustration of the second nozzle 15, including the converging section 21, central section 22, diverging section 23, and discharge outlet 16. That is, the second nozzle may include a converging section 21, a central section 22, and a diverging section 23. The converging section 21 includes a diameter of the internal nozzle 15 that becomes smaller from upstream to downstream. The central section 22 connects the converging section 21 and the diverging section 23. The central section 22 may be a plane perpendicular to the flow of water or may include a length in the direction of the flow of water. The diverging section 23 includes a diameter of the internal nozzle 15 that becomes larger from upstream to downstream. The internal nozzle 15 is integrally formed and/or physically attached to the toilet 100. The opening of the second nozzle 15 may have a central axis that is co-linear with the central axis of the opening of the first nozzle 14.

The second nozzle 15 opens in the discharge outlet 16. The discharge outlet 16 is coupled to a trapway 116 of the toilet 100 and configured to receive discharge from the second nozzle downstream of the suction port. The water pushed out throw the discharge outlet 16 pushes water in the sump 114 into the trapway 116 in order to break the siphon and cause the water in the toilet bowl to drain.

The flow of water through the second nozzle 15 and from the discharge outlet 16 may be considered a second flow of water. The first flow of water (e.g., into the suction reservoir 11) is at a first speed and a first volumetric flow rate. The second flow of water (e.g., from the discharge outlet 16) is at a second speed and a second volumetric flow rate. The first speed is greater than the second speed. The first volumetric flow rate is less than the second volumetric flow rate. The second flow of water flows through the second nozzle 15, out of the discharge outlet 16, and into the sump 114 in the first direction towards the front of the toilet 100. As the water flows through the sump 114 it may collect waste deposited into the toilet by a user and the waste may flow with the water to a sewage line. The water flows through the sump 114 and into the trapway 116 in the first direction, toward the front of the toilet. As shown in FIG. 2 the trapway 116 curves upward and to the right. Accordingly, the flow of water flows upward and to the right. After curving upward and to the right, the trapway 116 curves toward the back of the toilet 100. Accordingly, the water flows backward. After curving backward, the trapway 116 curves downward toward a drain or sewage line. The flow of water through the trapway 116 flows downwards toward a drain or a sewage line. As the water flows downwards, it flows perpendicular to the water flowing through the sump 114 in the first direction.

The toilet 100, may further include a hollow cavity 25 located between the bowl 106, the suction reservoir 11, and the second nozzle 15. The hollow cavity 25 may be used to shape the second nozzle 15. For example, the shape of the hollow cavity 25 may allow the second nozzle to have a converging shape, a diverging shape, or a converging and diverging shape.

Figure 3:
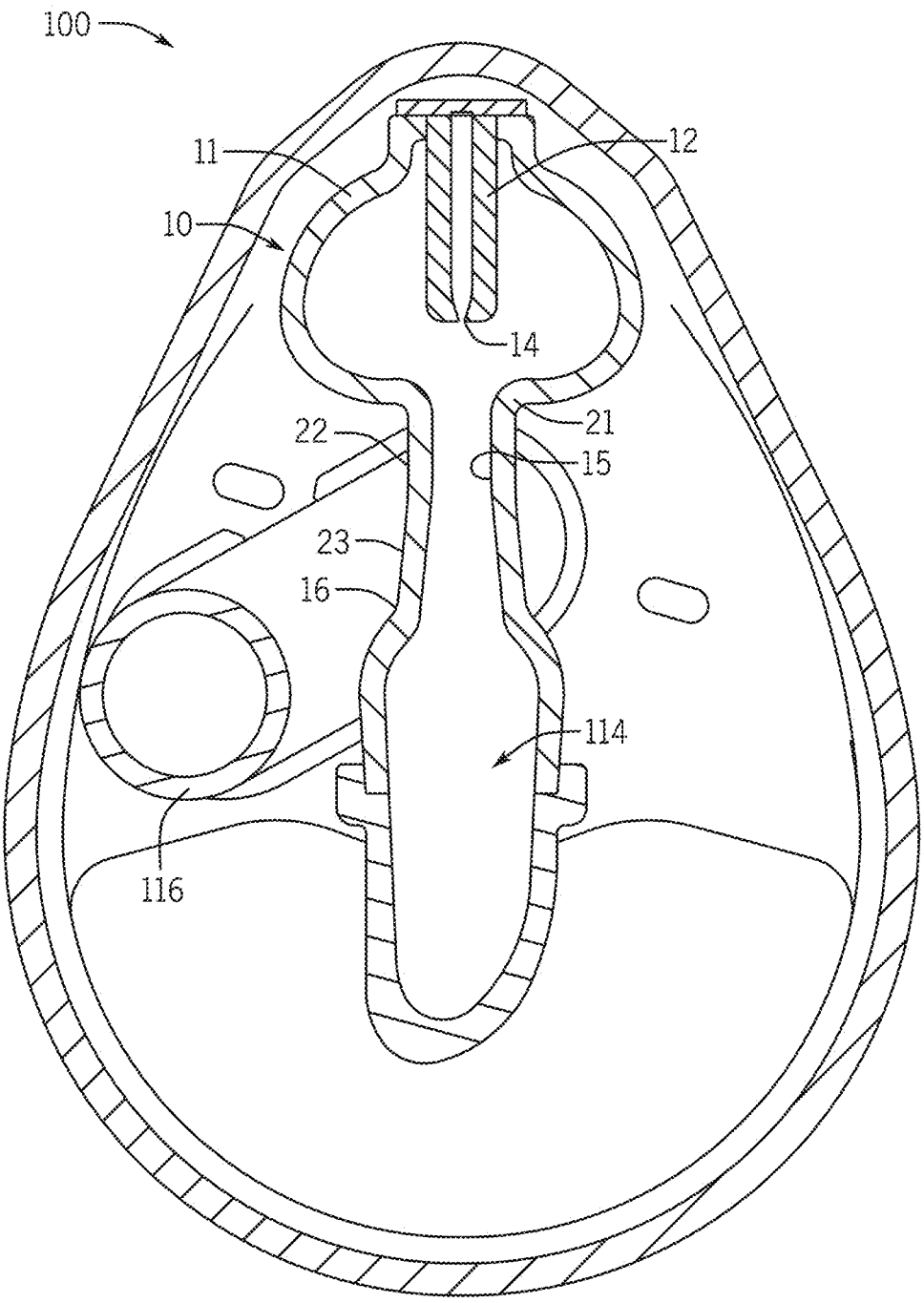
FIG. 3 illustrates a top cross section view of the eductor assisted toilet of FIG. 1, according to an exemplary embodiment of the present disclosure.

FIG. 3 illustrates a top cross section view of the toilet 100 of FIG. 2 according to an exemplary embodiment of the present disclosure. FIG. 3 illustrates the eductor assembly 10, the sump 114, and the trapway 116. The eductor assembly 10 includes a suction reservoir 11, flow driving device 12, first nozzle 14, second nozzle 15, and discharge outlet 16. The second nozzle 15 includes a converging section 21, central section 22, and diverging section 23.

As shown, the flow driving device 12 extends into the suction reservoir 11. In some embodiments, the flow driving device 12 extends less than halfway (i.e., less than half of the distance from the back of the suction reservoir 11 to the front of the suction reservoir 11) into the suction reservoir. In other embodiments, the flow driving device 12 extends halfway into the suction reservoir 11. In some embodiments, the flow driving device extends more than halfway into the suction reservoir 11. Accordingly, when the relatively high speed first flow of water flows out of the flow driving device 12 and the first nozzle 14 water in the suction reservoir is pulled, through the Bernoulli effect, from all around the nozzle 14, including behind the flow driving device 12. The flow driving device 12 and first nozzle 14 may extend into the suction reservoir 11 such that a specific fraction of the volume of the water in the suction reservoir 11 comes from behind the flow driving device 12 and the first nozzle 14.

As shown, the second nozzle 15 includes a converging section 21, a central section 22, and a diverging section 23. The converging section 21 includes a diameter of the second nozzle 15 that becomes smaller from upstream to downstream. The converging section 21 of the second nozzle 15 may be less than half of the total length of the second nozzle 15. The converging section 21 may be less than on quarter of the total length of the second nozzle 15. The converging section 21 has a circumference that becomes smaller from upstream to downstream. The central section 22 connects the converging section 21 and the diverging section 23. The central section 22 may have a constant diameter and a constant circumference from upstream to downstream. The central portion 22 may be less than half of the total length of the second nozzle 15. The central portion 22 may be more than half of the total length of the second nozzle 15. The diverging section 23 has a diameter that becomes larger from upstream to downstream. The diverging section 23 may be less than half of the total length of the second nozzle. The diverging section 23 may be more than half of the total length of the second nozzle 15. The diverging section 23 may be less than a quarter of the total length of the second nozzle 15. The diverging section 23 may have a circumference that becomes larger from upstream to downstream. The portion of the second nozzle 15 having the smallest diameter may not have a diameter less than half of the diameter of the portion of the second nozzle 15 having the largest diameter. The portion of the second nozzle 15 having the smallest diameter may have a diameter less than half of the diameter of the portion of the second nozzle 15 having the largest diameter.

As shown in FIG. 3, the first flow of water flows in a first direction toward the front of the toilet 100 from the first nozzle 14 into the suction reservoir 11. The second flow of water then flows through the second nozzle 15 into the sump 114. As illustrated in FIG. 3, the portion of the trapway 116 shown provides for a flow of water in a direction substantially perpendicular to the flow of water through the sump 114.

Figure 4:
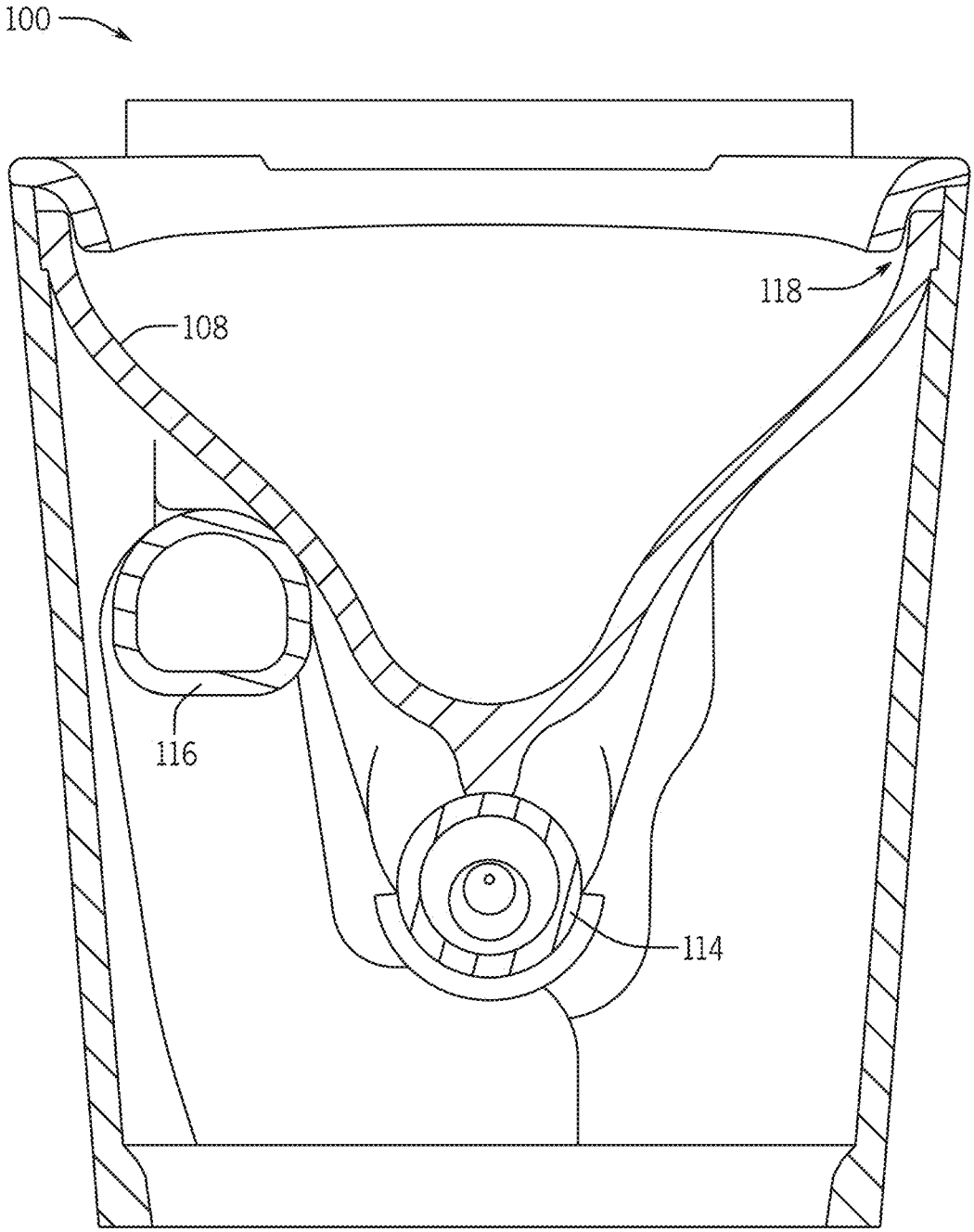
FIG. 4 illustrates a front cross section view of the eductor assisted toilet of FIG. 1, according to an exemplary embodiment of the present disclosure.

FIG. 4 illustrates a front cross section view of the toilet 100 of FIGS. 2 and 3 according to an exemplary embodiment of the present disclosure. As shown in FIG. 4, the rim outlet 118 may be located near the top of the bowl 108. The rim jet 118 is supplied with water from the water supply conduit 104 connected to a building water supply. The rim jet 118 is configured to supply water to the bowl 108 of the toilet 100. The rim jet may fill the eductor assembly 10, the sump 114, and the bowl 108 of the toilet 100 with water at the end of a flush cycle. The rim jet 118 may include one or more outlets through which water flows into the bowl 108 of the toilet. During a flush cycle, water and any waste deposited into the toilet 100 flows through the sump 114 toward the front of the toilet 100. During a flush cycle, water and any waste deposited into the toilet 100 flows through the trapway 116 towards the back of the toilet 100 before exiting the toilet through a drain or sewage line.

Figure 5:
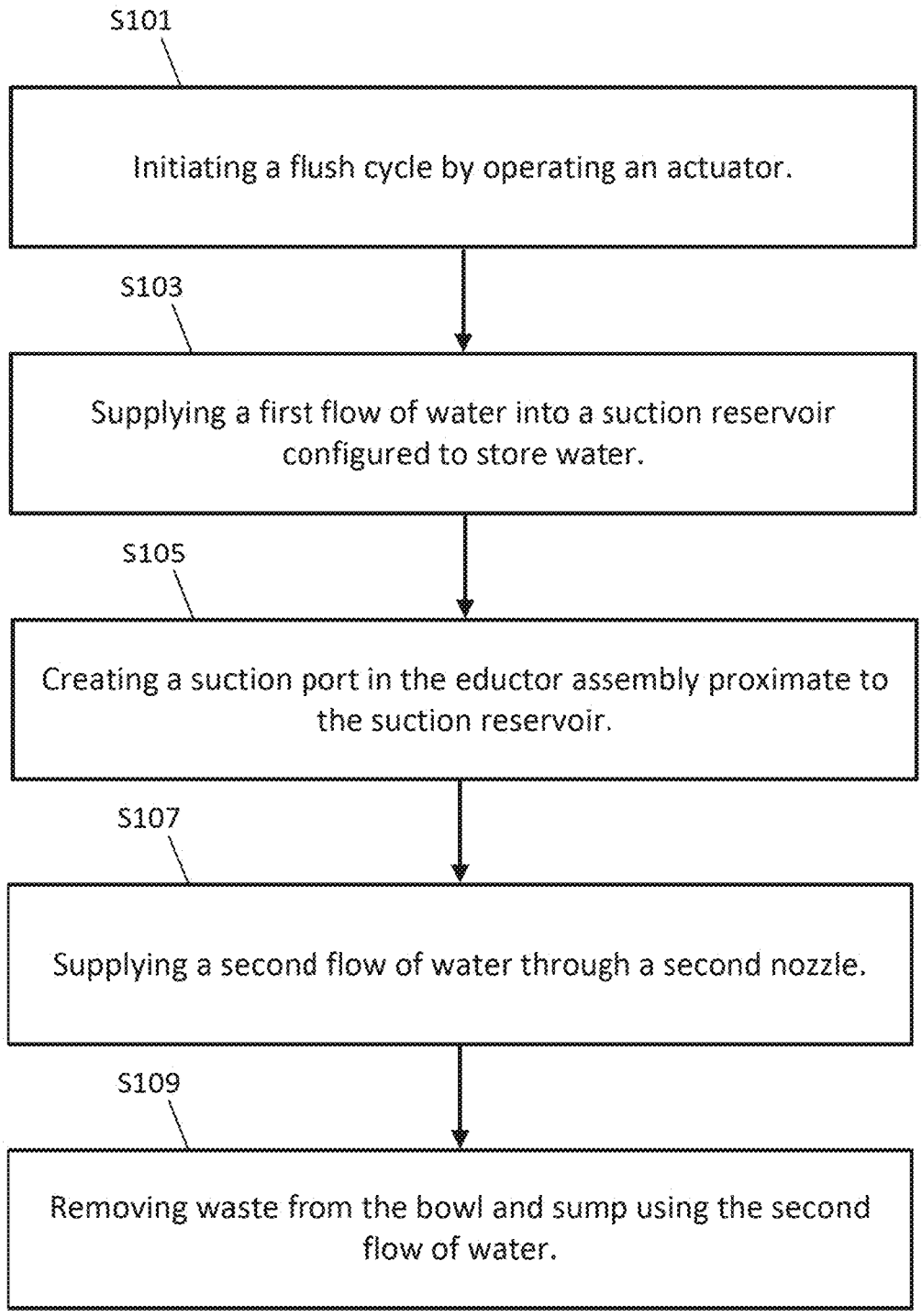
FIG. 5 illustrates an example flowchart for a method of performing a flush cycle for an eductor assisted toilet according to an exemplary embodiment of the present disclosure.

Referring to FIG. 5, a flowchart illustrating a method of performing a flush cycle according to an exemplary embodiment of the present disclosure is shown. Additional, different, or fewer acts may be included. Acts may be repeated or performed in any order.

In act S101, a flush cycle is initiated by operation of an actuator. The actuator may be a button configured to initiate the flush cycle when depressed (or pulled) a predetermined distance or when touched, a lever configured to activate when rotated a predetermined angular travel, or any suitable device configured to activate based on an input manipulation by a user. In some embodiments, the actuator may be a sensor (e.g., a proximity sensor) and the flush cycle may be automatically initiated (e.g., by a controller) based on sensor data received from the sensor.

Figure 6:
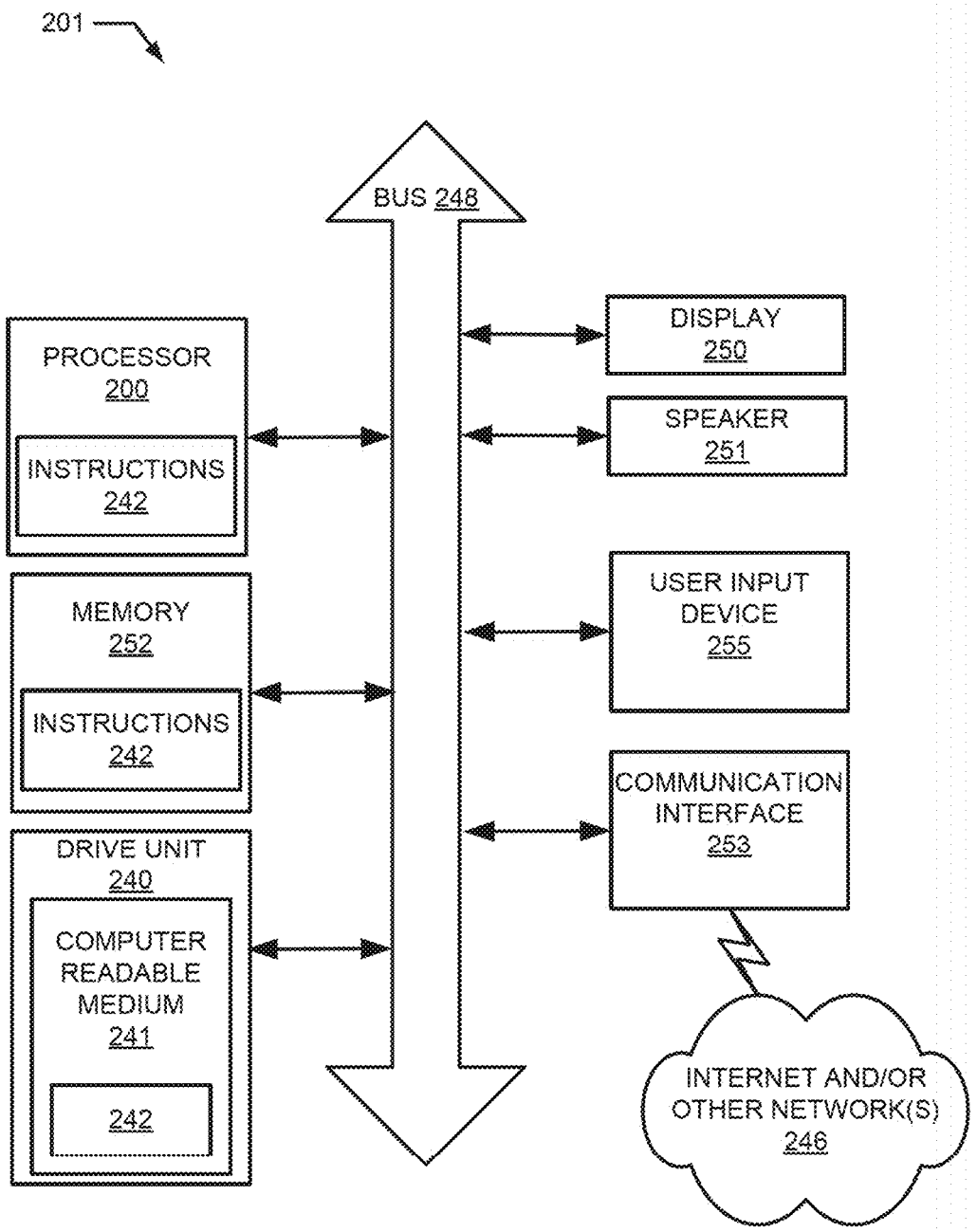
FIG. 6 illustrates an example controller for the eductor assisted toilet.

In the instance of automatic initiation of the flush cycle, a controller, such as the controller 201 described herein with respect to FIG. 6, may receive sensor data indicative of usage of the toilet. For example, the controller 201 may be in communication with a sensor configured to detect the presence of a user, and initiate the flush cycle in response to a user leaving the vicinity of the toilet.

The sensor may include any type of sensor configured to detect certain actions and/or to provide functionality (e.g., dispensing, flushing, etc.). The sensor may include any type of sensor configured to detect certain conditions and/or to provide functionality. For example, the sensor may be configured to detect a water level in the bowl 106 or a blockage in the trapway 116. Odor sensors, proximity sensors, and motion sensors are non-limiting examples of sensors that may be employed with the systems of this application. Odor sensors, such as volatile organic compound (VOC) sensors, may be employed to detect organic chemicals and compounds, both human made and naturally occurring chemicals/compounds. Proximity sensors may be employed to detect the presence of an object within a zone of detection without physical contact between the object and the sensor. Electric potential sensors, capacitance sensors, projected capacitance sensors, and infrared sensors (e.g., projected infrared sensors, passive infrared sensors) are non-limiting examples of proximity sensors that may be employed with the systems of this application. Motion sensors may be employed to detect motion (e.g., a change in position of an object relative to the objects surroundings). Electric potential sensors, optic sensors, radio-frequency (RF) sensors, sound sensors, magnetic sensors (e.g., magnetometers), vibration sensors, and infrared sensors (e.g., projected infrared sensors, passive infrared sensors) are non-limiting examples of motion sensors that may be employed with the systems of this application.

In another example, the sensor may include a light detection and ranging (LiDAR) that servers as a proximity sensor. The controller 201 receives sensor data such as a point cloud, from the sensor and analyzes the sensor data to determine when a user is approaching or has approached the toilet 100.

In another example, the sensor may include a sensor configured to detect a water level. The sensor may include a float sensor, a pressure level sensor, an ultrasonic water level transmitter, a capacitance level sensor (e.g., an RF sensor), and a radar level sensor. Further, an optical sensor may be used to determine a water level.

The processor 200 may be a general purpose or specific purpose processor, an application specific integrated circuit (ASIC), one or more programmable logic controllers (PLCs), one or more field programmable gate arrays (FPGAs), a group of processing components, or other suitable processing components. Processor 200 is configured to execute computer code or instructions stored in memory 252 or received from other computer readable media (e.g., embedded flash memory, local hard disk storage, local ROM, network storage, a remote server, etc.). The processor 200 may be a single device or combinations of devices, such as associated with a network, distributed processing, or cloud computing.

Memory 252 may include one or more devices (e.g., memory units, memory devices, storage devices, etc.) for storing data and/or computer code for completing and/or facilitating the various processes described in the present disclosure. Memory 252 may include random access memory (RAM), read-only memory (ROM), hard drive storage, temporary storage, non-volatile memory, flash memory, optical memory, or any other suitable memory for storing software objects and/or computer instructions. Memory 252 may include database components, object code components, script components, or any other type of information structure for supporting the various activities and information structures described in the present disclosure. Memory 352 may be communicably connected to processor 200 via a processing circuit and may include computer code for executing (e.g., by processor 200) one or more processes described herein. For example, memory 252 may include graphics, web pages, HTML files, XML files, script code, shower configuration files, or other resources for use in generating graphical user interfaces for display and/or for use in interpreting user interface inputs to make command, control, or communication decisions.

In addition to ingress ports and egress ports, the communication interface 253 may include any operable connection. An operable connection may be one in which signals, physical communications, and/or logical communications may be sent and/or received. An operable connection may include a physical interface, an electrical interface, and/or a data interface. The communication interface 253 may be connected to a network. The network may include wired networks (e.g., Ethernet), wireless networks, or combinations thereof. The wireless network may be a cellular telephone network, an 802.11, 802.16, 802.20, or WiMax network, a Bluetooth pairing of devices, or a Bluetooth mesh network. Further, the network may be a public network, such as the Internet, a private network, such as an intranet, or combinations thereof, and may utilize a variety of networking protocols now available or later developed including, but not limited to TCP/IP based networking protocols.

While the computer-readable medium (e.g., memory 252) is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. The computer-readable medium may be non-transitory, which includes all tangible computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In act S103, a first flow of water (e.g., motive fluid) is supplied to the eductor assembly 10 through a flow driving device 12. The first flow of water is supplied to the suction reservoir 11, which is configured to store water. The flow driving device 12 may receive water from a water supply line inside a household, commercial property, or other type of building. The water may be supplied to the flow driving device 12 at a city water pressure or well pump pressure. The first flow enters the flow driving device 12 through the input port having a first diameter. The first flow then flows through the first nozzle 14, the downstream end of the first nozzle 14 having a second diameter. The second diameter may be less than the first diameter and the first nozzle may cause the speed of the water to increase. After flowing through the first nozzle 14, the first flow enters the eductor assembly 10. The first flow then flows through the first nozzle 14 and into the eductor assembly 10. The first flow has a first speed and a first volumetric flow rate. The first speed may be a relatively high speed and the first volumetric flow rate may be relatively low.

In act S105, a suction port 13 is created in the eductor assembly. The suction port 13 is created as the Bernoulli effect of the relatively high speed (and corresponding low pressure) of the first flow pulls water located in the suction reservoir 11 and/or suction region 20 toward the first flow. The suction port 13 may be located proximate to the flow driving device 12 and/or the suction reservoir 11. The suction port 13 may be located in the suction reservoir 11 and/or the suction region 20.

In act S107, a second flow is supplied to the sump 114 through the second nozzle 15. The second flow includes water (i.e., motive fluid) from the first flow and water from the suction reservoir 11 and/or suction region 20 that is pulled toward the first flow via the suction port 13 and/or the Bernoulli effect. The second flow of water flows through the second nozzle 15 into the sump 114 and/or the bowl 106 of the toilet 100. The second flow of water has a second speed and a second volumetric flow rate. The second speed may be less than the first speed and the second volumetric flow rate may be greater than the first volumetric flow rate.

In act S109, the second flow of water removes waste from the sump 114 and/or the bowl of the toilet 100. The second flow may enter the sump 114 and/or the bowl 106 and remove waste through the trapway 116 of the toilet. The second flow of water may wash the surfaces of the sump 114 and/or bowl 106 as it flows towards the trapway 116. Additional, fewer, or different components may be included without departing from the spirit or scope of the present disclosure. In some embodiments, the rim jet 118 may supply water, refilling the bowl 106, sump 114, and suction reservoir 11 at the end of the flush cycle.

FIG. 6 illustrates an example controller 201, for the automatic initiation of a flush cycle. The controller 201 may include a processor 200, a memory 252, and a communication interface 253 for interfacing with devices or to the internet and/or other networks 246. In addition to the communication interface 253, a sensor interface may be configured to receive data from the sensors described herein or data from any source for the position of the user. The components of the control system 201 may communicate using bus 248. The control system 201 may be connected to a workstation or another external device (e.g., control panel) and/or a database for receiving user inputs, system characteristics, and any of the values described herein.

Optionally, the control system 201 may include an input device 255 and/or a sensing circuit in communication with any of the sensors. The sensing circuit receives sensor measurements from as described above. The input device 255 may include a touchscreen coupled to or integrated with the toilet, a keyboard, a microphone for voice inputs, a camera for gesture inputs, and/or another mechanism.

Optionally, the control system 200 may include a drive unit 240 for receiving and reading non-transitory computer media 241 having instructions 242. Additional, different, or fewer components may be included. The processor 300 is configured to perform instructions 242 stored in memory 252 for executing the algorithms described herein. A display 250 may be supported by any of the components described herein. The display 250 may be combined with the user input device 255. The control system may further include a speaker 251.

Figure 7A:
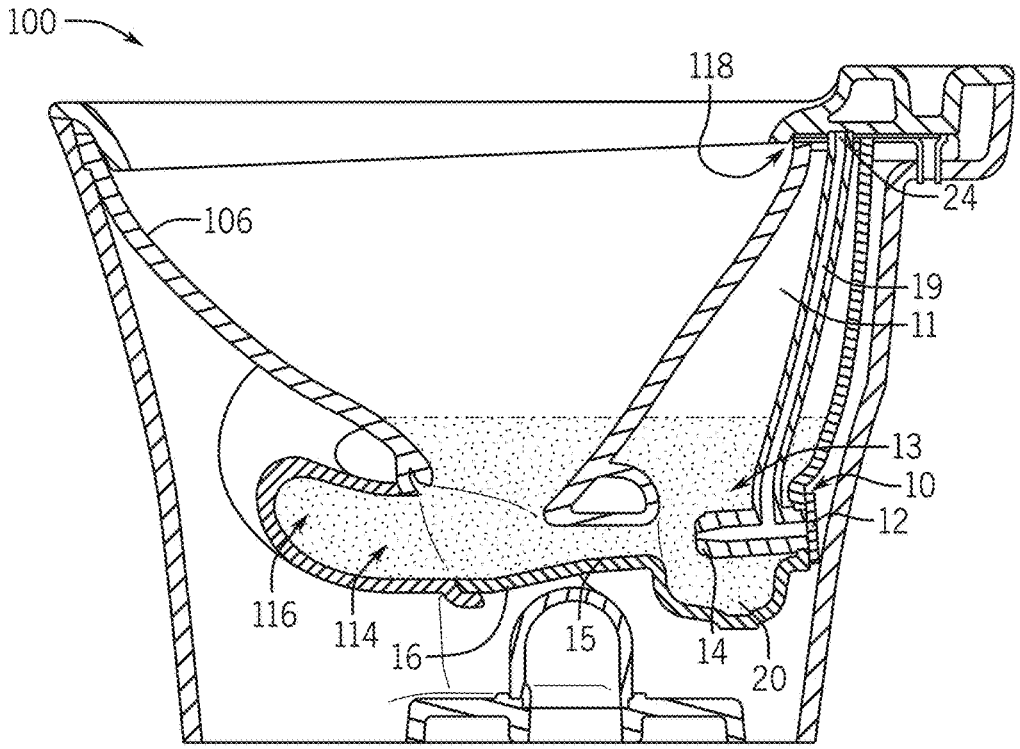
FIGS. 7A-7D illustrate the toilet of FIGS. 1-4 during several states that may occur during a flush cycle, according to an exemplary embodiment of the present disclosure.

Referring to FIGS. 7A-7D, an eductor assisted toilet according to an exemplary embodiment of the present disclosure is shown during several different states that may occur during a flush cycle. FIG. 7A shows an eductor assisted toilet according to an exemplary embodiment of the present disclosure in a first state in which a flush cycle has not been initiated. The toilet 100, in the first state, contains water in the sump 114 and eductor assembly 10 and specifically, in the suction reservoir 11. Water may also be stored in the passage of the nozzle 15 and/or the suction region 20. The bowl 106, sump 114, and eductor assembly 10 may further include waste deposited into the toilet 100 during use.

Figure 7B:
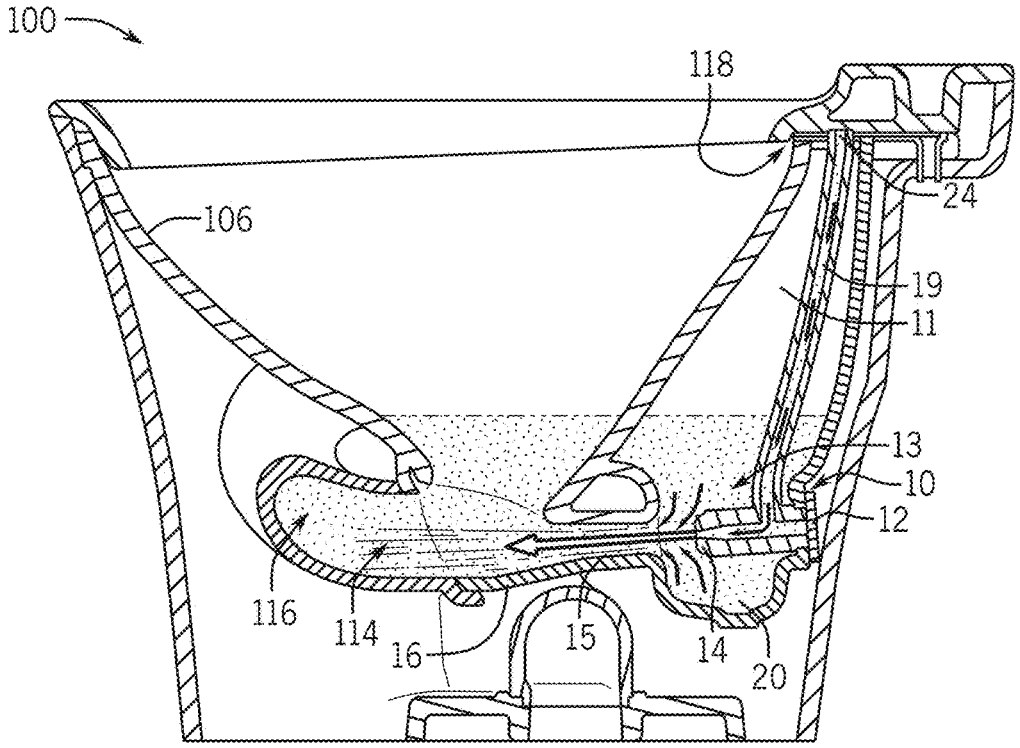

FIG. 7B shows the eductor assisted toilet of FIG. 7A in a second state in which a flush cycle has been initiated. In the second state, the flow driving device 12 begins to supply a first flow of a motive fluid (e.g., water) to the eductor assembly 10. The motive fluid flows through the first flow nozzle 14 located in the flow driving device 12 and enters the eductor assembly 10 at a relatively high speed. The motive fluid may flow into the suction reservoir 11 and/or the suction region 20 of the eductor assembly 10. The Bernoulli effect from the high-speed flow of the motive fluid causes suction and creates a suction port 13 in the suction reservoir 11 and/or suction region 20. The Bernoulli effect includes forces, shown by arrows in FIGS. 7B-7D, that create the suction port 13 and pull water from the suction reservoir 11 and/or suction region 20 to flow with the first flow towards the second nozzle 15. The forces are all around the outlet of the flow driving device 12 (e.g., at tapered portion 18). The forces may be inversely proportional to the distance, or the square of the distance, from the tapered portion 18 to the corresponding location in the suction reservoir 11.

Figure 7C:
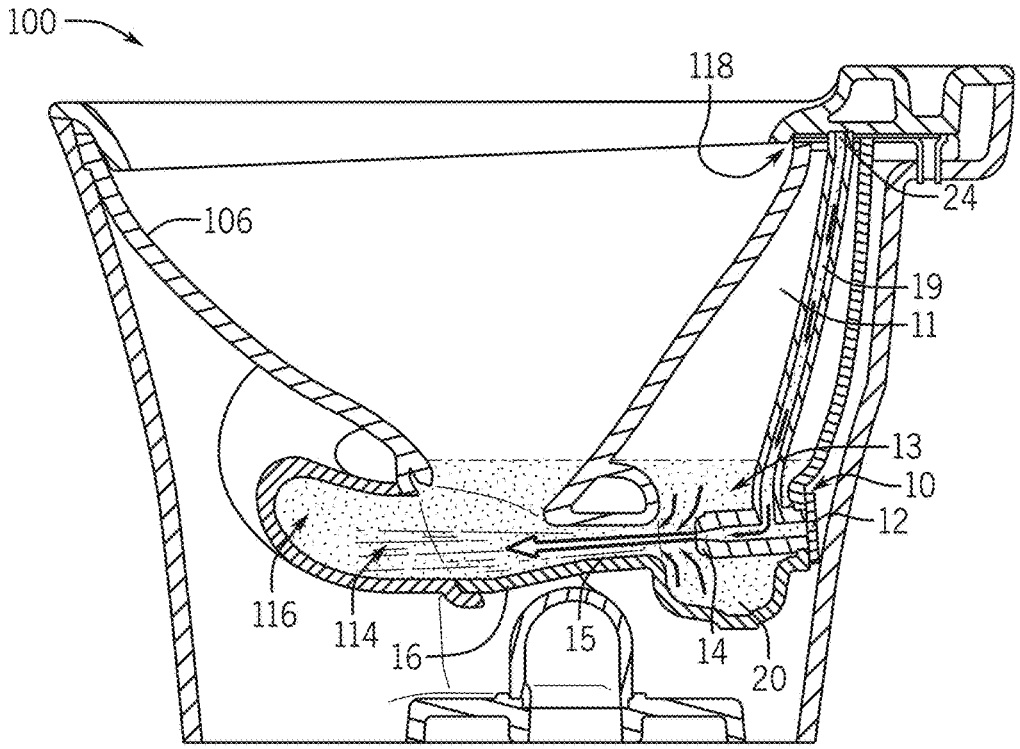

FIG. 7C shows the eductor assisted toilet of FIG. 7A in a third state. In the third state, the first flow of motive fluid continues to flow into the eductor assembly 10. The suction port 13 created by the first flow continues to pull water from the suction reservoir 11 and/or suction region 20 toward the second nozzle. In a third state, a second flow comprising the motive fluid of the first flow and the water of the suction port 11 and/or suction region 20 is created and flows through a second nozzle 15. The second flow may have a lower speed than the first flow. The second flow may have a greater volumetric flow rate than the first flow. The second flow of water flows through the second nozzle 15 and out the discharge outlet 16 through the sump 114 and into the trapway 116. As the second flow flows through the trapway, it may collect waste deposited into the bowl 106 and sump 114 and remove it through the trapway 116. In the third state, as illustrated in FIG. 7A some of the water from the suction reservoir 11 has flown out of the suction reservoir 11 and through the second nozzle 15 into the sump 114.

Figure 7D:
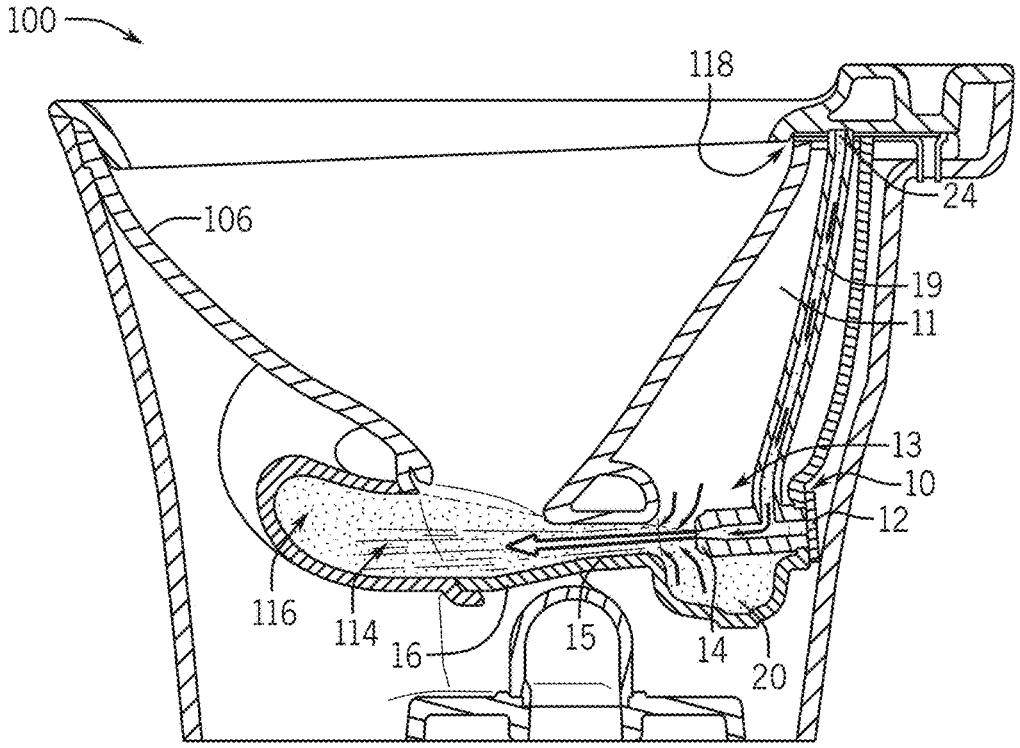

FIG. 7D shows the eductor assisted toilet of FIG. 7A in a fourth state. In the fourth state, the first flow continues to flow from the flow driving device into the eductor assembly 10 and the second flow continues to flow through the second nozzle 15, through the sump 114 and into the trapway 116. In the fourth state, as shown in FIG. 7D, more water has flown out of the suction reservoir 11 than in FIG. 7C. In the fourth state, the second flow of water continues through the sump 114 removing any waste in the sump 114 and bowl 1066, removing waste and washing the surface of the sump 114 and/or bowl 106. In some embodiments, the water in the suction port 20 may also be evacuated through the second nozzle 15 and sump 114 into the trapway 116.

In some embodiments, after the flushing method as illustrated in FIG. 5 and as illustrated in FIGS. 7A-7D, the rim jet 118 may dispense water into the bowl 106, refilling the bowl 106, sump 114, and eductor assembly 10. The rim jet 118 may refill the water in the toilet 100 as is shown in the first state as shown in FIG. 7A.

Figure 8:
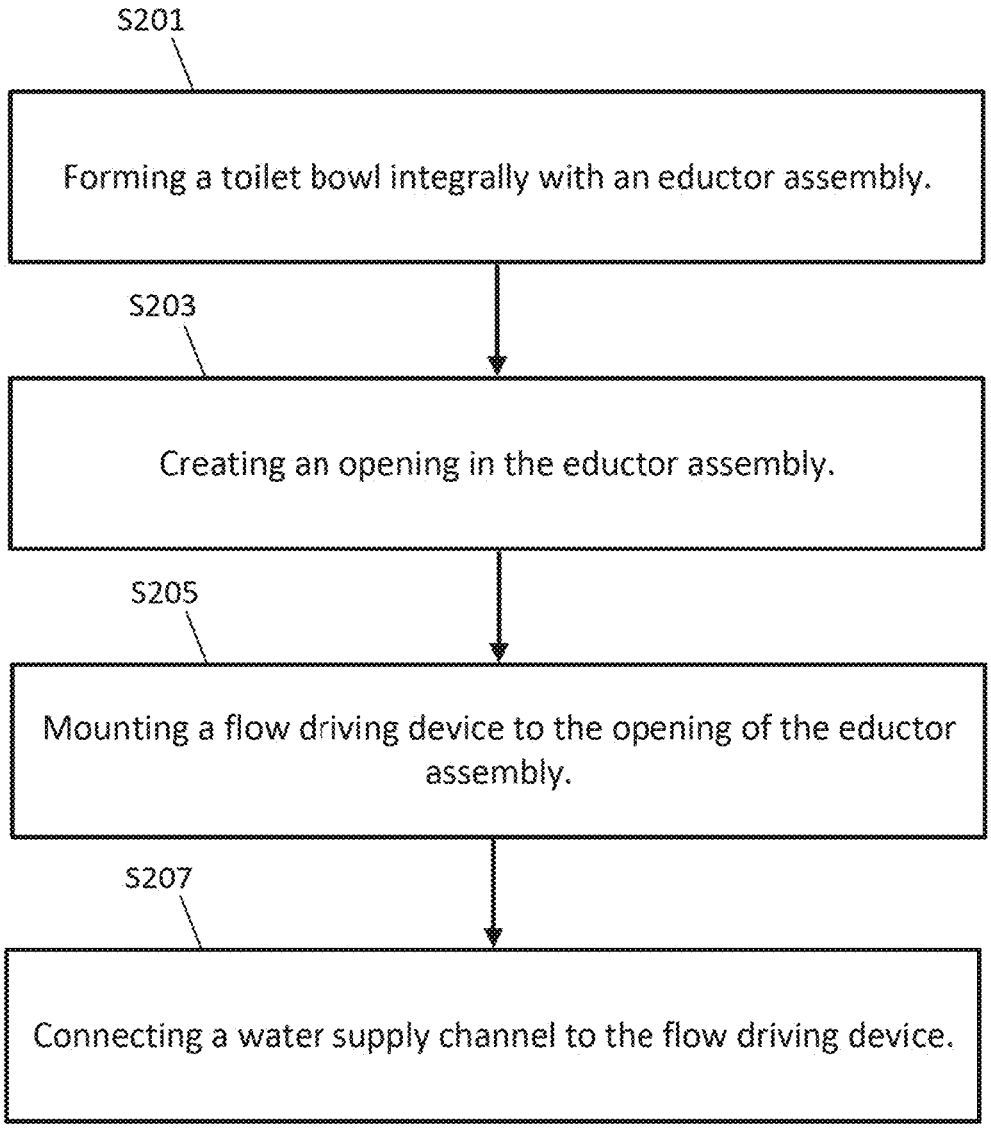
FIG. 8 illustrates an example flowchart for manufacturing an eductor assisted toilet is shown according to an exemplary embodiment of the present disclosure.

FIG. 8, illustrates an example flow chart for manufacturing of the eductor assisted toilet. Additional, different, or fewer acts may be included. Acts may be repeated or performed in any order.

FIGS. 2-4, 9, and 10 illustrate embodiments of the eductor assisted toilet and images for casting and manufacturing of the toilet 100 with the eductor assembly 10. The process may include a vitreous casting process. The casting process may be a solid casting process or a drain casting process. According to other exemplary embodiments, the toilet 100 with portions of the eductor assembly 10 is cast from other types of materials or combinations of materials, such as ceramic, composite, epoxy, or other types of materials.

In some embodiments, the eductor assembly 10 may be a plumbing fixtures made from a vitreous material by a casting process, where a slip material or tube is utilized to form a hollow trapway within the plumbing fixture when the plumbing fixture is cast. After the plumbing fixture is cast, an orifice may be formed for the flow driving device 12 through a solid casted wall of the plumbing fixture by manually using a punch to fluidly couple the bowl to a fluid channel of the plumbing fixture or a drain casting purpose.

At act S201, the process includes forming a toilet bowl integral with an eductor assembly. For example, the toilet bowl 106 and eductor assembly 10 may be formed simultaneously using a casting process. The toilet bowl 106 and eductor assembly 10 may be formed using a solid casting process or a drain casting process. In a solid casting process, the bowl 106 and eductor assembly 10 are cast as one piece using a mold. After casting in the mold, holes fluidly connecting the bowl 106, sump 114, and eductor assembly 10 are manually punched. In the drain casting process, a mold having a basic shape of the structure of the toilet 100 may be filled with a liquid clay slip. In the mold, the trapway 116, sump 114, and eductor assembly may be fluidly connected forming a continuous drain casting pathway. The liquid clay slip sets in the mold to cast the walls of the toilet 100. The liquid clay slip is then drained, and a can may be used to open (i.e., fluidly connect) the bowl and the sump.

At act S203, the process includes providing or creating an orifice in the eductor assembly for the flow driving device. Act S203 may be part of act S201 and not performed in sequence. In the solid cast method, an orifice in the eductor assembly may be manually punched in a wall of the eductor assembly 10. In the drain cast method, a can may be used to create an orifice for the for the flow driving device in a wall of the eductor assembly 10. The orifice may be located on a side wall of the eductor assembly 10. In other embodiments, the orifice may be provided on the bottom of the eductor assembly 10. In some embodiments, a second orifice may be similarly provided on the toilet body 102. The orifice may be created in the eductor assembly before or after the toilet is fired in a kiln.

At act S205, the process includes attaching a supply channel 19 and a flow driving device 12 to the eductor assembly via the orifice. In some embodiments, the supply channel 19 may be a tube or hose. The supply channel 19 may be inserted into the suction reservoir 11 and fluidly connected to the input port 24. The supply channel 19 may be inserted into and locked into the input port 24. A recess and dimple, spring loaded pin and recess or the like may be used to lock the supply channel 19 into a position in which it is fluidly connected to the input port 24. In other embodiments, the supply channel 19 may be integrally formed with the input port 24 in the eductor assembly 10. The flow driving device may be inserted into the orifice in the eductor assembly 10 and locked into position with the eductor assembly 10 and/or with a recess and dimple, spring loaded pin and recess or the like.

At act S207, a water supply line 19 is connected to the flow driving device. The water supply channel 19 may be integral to the toilet for connecting to the water supply of a building. The water supply channel 19 may be the water supply of the building itself. The water supply line may be a hose or a tube. In some embodiments, the flow driving device 12 is rotated such that an orifice on the flow driving device aligns with the hollow channel of the water supply channel 19. In other embodiments the flow driving device 12 may have a recess in which the water supply channel 19 locks. A dimple and recess may be used to lock the connection between the fluid supply channel 19 and flow driving device 12. A spring loaded pin and recess may be used to lock the connection between the supply channel 19 and the flow driving device 12.

Additional, different, or fewer acts may be included. Acts may be repeated or performed in any order.

Figure 9:
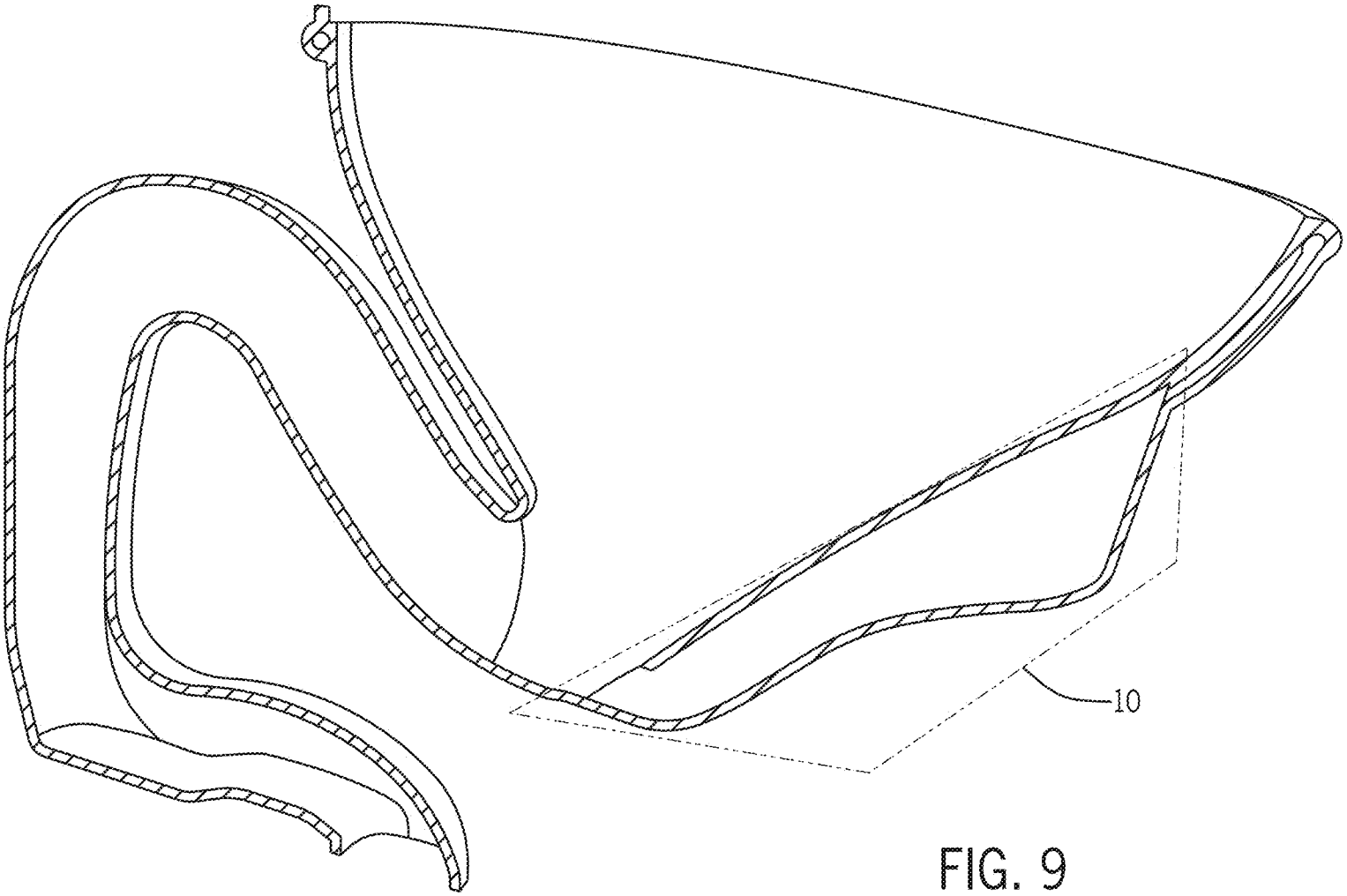
FIG. 9 illustrates another embodiment of an eductor assisted toilet according to an exemplary embodiment of the present disclosure.

FIG. 9 illustrates another embodiment of an eductor assisted toilet according to an exemplary embodiment of the present disclosure. As shown in FIG. 8, the eductor assembly 10 may be located at the front of the toilet 100 and the trapway 116 may be located at the rear of the toilet 100.

Referring to FIG. 10 another embodiment of an eductor assisted toilet according to an exemplary embodiment of the present disclosure is shown. As shown in FIG. 9, the eductor assembly 10 may be located at the front of the toilet 100 and the trapway 116 ma be located at the rear of the toilet 100.

When a component, device, element, or the like of the present disclosure is described as having a purpose or performing an operation, function, or the like, the component, device, or element should be considered herein as being "configured to" meet that purpose or to perform that operation or function.

The phrases "coupled with" or "coupled to" include directly connected to or indirectly connected through one or more intermediate components. Additional, different, or fewer components may be provided. Additional, different, or fewer components may be included.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

What is claimed is:

1. An eductor assembly for a toilet, the eductor assembly comprising:

a suction reservoir configured to store a supply of water;

a flow driving device configured to supply a flow of water to the eductor assembly and in fluid communication with the suction reservoir to create a suction port proximate to the flow driving device and the suction reservoir;

a first nozzle at the end of the flow driving device;

a second nozzle with a central section connecting both a converging end section and a diverging end section downstream of the suction port; and a discharge outlet coupled to a trapway of the toilet and configured to receive discharge from the second nozzle downstream of the suction port.

2. The eductor of claim 1, wherein the suction reservoir is attached to a bowl of the toilet.

3. The eductor of claim 1, wherein the suction reservoir is integrally formed with a bowl of the toilet.

4. The eductor of claim 1, further comprising:

an input port of the flow driving device having a first diameter, wherein the first nozzle has a second diameter different from the first diameter, wherein the input port is connected to a line supply of water.

5. The eductor of claim 1, wherein the second nozzle includes a converging section and a diverging section.

6. The eductor of claim 1, wherein the second nozzle is integrally formed with the suction reservoir of the toilet.

7. The eductor of claim 1, wherein the first nozzle outputs a first flow of water into the suction reservoir at a first speed and a first volumetric flow rate.

8. The eductor of claim 7, wherein the discharge outlet outputs a second flow of water into the trapway at a second speed and a second volumetric flow rate.

9. The eductor of claim 8, wherein the first speed is greater than the second speed.

10. The eductor of claim 8, wherein the first volumetric flow rate is less than the second volumetric flow rate.

11. A toilet comprising:

a toilet bowl;

a trapway connected to the toilet bowl; and an eductor assembly, the eductor assembly comprising:

a suction reservoir configured to store a supply of water;

a flow driving device configured to supply a flow of water to the eductor assembly and in fluid communication with the suction reservoir to create a suction port proximate to the flow driving device and the suction reservoir;

a first nozzle at the end of the flow driving device;

a second nozzle with a central section connecting both a converging end section and a diverging end section downstream of the suction port; and a discharge outlet coupled to the trapway of the toilet and configured to receive discharge from the second nozzle downstream of the suction port.

12. The toilet of claim 11, wherein the suction reservoir is attached to a bowl of the toilet.

13. The toilet of claim 11, wherein the suction reservoir is integrally formed with a bowl of the toilet.

14. The toilet of claim 11, further comprising:

an input port of the flow driving device having a first diameter, wherein the first nozzle has a second diameter different from the first diameter, wherein the input port is connected to a line supply of water.

15. The toilet of claim 11, wherein the second nozzle includes a converging section and a diverging section.

16. The toilet of claim 11, wherein the second nozzle is integrally formed with the suction reservoir of the toilet.

17. The toilet of claim 11, wherein the first nozzle outputs a first flow of water into the suction reservoir at a first speed and a first volumetric flow rate.

18. The toilet of claim 17, wherein the discharge outlet outputs a second flow of water into the trapway at a second speed and a second volumetric flow rate.

19. The toilet of claim 18, wherein the first speed is greater than the second speed and wherein the first volumetric flow rate is less than the second volumetric flow rate.

20. An eductor assembly for a toilet, the eductor assembly comprising:

a suction reservoir configured to store a supply of water;

a flow driving device configured to supply a flow of water to the eductor assembly and in fluid communication with the suction reservoir to create a suction port proximate to the flow driving device and the suction reservoir; and a second nozzle with a central section connecting both a converging end section and a diverging end section coupled to a trapway of the toilet and configured to receive discharge from the suction port.

* * * * *